US006540011B2

(12) United States Patent
Donini et al.

(10) Patent No.: US 6,540,011 B2
(45) Date of Patent: Apr. 1, 2003

(54) METHOD TO CONTROL THE AXIAL POSITION OF SLABS EMERGING FROM CONTINUOUS CASTING AND RELATIVE DEVICE

(75) Inventors: Estore Donini, Vimercate (IT); Andrea Carboni, Milan (IT); Roberto Millone, Genoa (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/782,522

(22) Filed: Feb. 14, 2001

(65) Prior Publication Data

US 2001/0040020 A1 Nov. 15, 2001

(30) Foreign Application Priority Data

Feb. 15, 2000 (IT) ..... UD2000A31

(51) Int. Cl.[7] ..... B22D 11/20; B22C 19/04

(52) U.S. Cl. ..... 164/476; 164/477; 164/484; 164/454; 164/447; 164/155.4; 164/441

(58) Field of Search ..... 164/452, 454, 164/477, 476, 417, 154.1, 484, 442, 447, 448, 156.4; 72/250, 231, 232, 9.3, 11.1, 240

(56) References Cited

U.S. PATENT DOCUMENTS 4,624,637 A 11/1986 Genesio et al.
4,944,342 A * 7/1990 Lauener ..... 164/423

FOREIGN PATENT DOCUMENTS

| | | | |
|---|---|---|---|
| DE | 34 27 708 A1 | * | 2/1986 |
| EP | 0175093 | | 3/1986 |
| JP | 61222626 | | 10/1986 |
| JP | 361222626 A | * | 10/1986 |
| JP | 404210855 A | * | 7/1992 |
| JP | 405154534 A | * | 6/1993 |
| WO | WO-99/24186 | * | 5/1999 |

* cited by examiner

*Primary Examiner*—M. Alexandra Elve
*Assistant Examiner*—Kevin McHenry
(74) *Attorney, Agent, or Firm*—Stevens, Davis, Miller & Mosher, LLP

(57) ABSTRACT

Method and device to control the axial position of slabs emerging from continuous casting applied in rolling plants comprising at least a casting machine (11), a heating and/or temperature maintenance furnace (15) and a roughing and prefinishing (16) or finishing train (19) comprising at least one rolling stand (17), the method serving to align the axis (32) of a slab (24) entering the furnace (15) with the axis (25) of the first rolling stand (17), the method providing to control the axial position of the slab (24) and to activate at least a thruster element (26) able to be introduced inside the furnace (15) to act on the edge of the slab (24) and displace it laterally according to a measured discrepancy between the axis (32) of the slab (24) and the axis (25) of the rolling stand (17), wherein the thruster element (26) has a contact element (28) able to cooperate with the edge of the slab (24) advancing inside the furnace (15).

31 Claims, 2 Drawing Sheets

METHOD TO CONTROL THE AXIAL POSITION OF SLABS EMERGING FROM CONTINUOUS CASTING AND RELATIVE DEVICE

FIELD OF THE INVENTION

This invention concerns a method to control the axial position of slabs emerging from continuous casting, and the relative device, used in rolling plants with a rolling train located in line with the continuous casting, to obviate the problems of misalignment of the slab emerging from casting with respect to the axis of the first rolling stands.

The invention is applied both in cases where the slab is sheared to size into segments, and also in the case where the slab is worked without interruption from the casting to the train.

To be more exact, the invention is applied in conventional plants for thin slabs, in plants for long slabs from about 20 m to about 60 m, and in plants of the semi-endless type with long slabs of up to 300 m.

BACKGROUND OF THE INVENTION

One of the problems which businessmen operating in the field of rolling plants complain of is that concerning the control of the axial position of the slab with respect to the axis of the first rolling stands located downstream of the heating furnace.

For it is well-known that, since the slab emerging from the continuous casting is subjected to the steps extraction, pre-rolling and straightening, it rarely keeps a correct alignment with respect to the axis of feed; this creates problems when it enters the rolling stands and during the rolling steps.

Moreover, as it masses inside the tunnel, heating or temperature-maintenance furnaces, the slab car be subject to lateral displacements which take it off-axis.

If the slab arrives misaligned with respect to the axis of the first stand, rolling becomes difficult, particularly in the case of rolling thin slabs.

In fact, to compensate for the misalignment after the slab has entered the stand, and to make sure that it enters the downstream stand correctly, it is necessary to level the rolls of the first stand, which has negative effects on the symmetry of the transverse section profile of the slab itself.

Although this does not create serious problems when the product is very thick, for example above 2 mm, for thin products there are serious problems regarding the guiding of the strip in the rolling mill, even though the strip is guided for only a limited segment, since making up the difference in thickness between one side and the other causes different elongations on the two sides and therefore causes the strip to bend on the horizontal plane. Rolling becomes difficult if not impossible to manage, moreover, for thicknesses of about 0.6–0.8 mm.

To try to solve these problems at least in part, conventional solutions provide to use the action, singly or combined, of lateral guides, of the jets of liquid of the cooling or descaling assemblies, or of the edging assemblies arranged between the outlet of the heating furnace and the entrance to the stand, in order to obtain the progressive axial centering of the slab with respect to the rolling axis.

These solutions have proved to be only partly effective, for various reasons.

First of all, there is a technological requirement which does not allow to greatly distance the entrance of the stand from the outlet of the furnace, to prevent excessive cooling of the slab below the optimum rolling temperature.

For this reason, it is necessary to obtain a high displacement of the slab per unit of plant length in order to obtain the desired alignment at entrance to the stand.

Conventional guide systems, however, are not able to obtain these values on displacement and therefore they do not make possible to achieve the alignment in the little space available between the furnace and the stands.

Conventional lateral guides, moreover, occupy a length of about 10 m of the segment between furnace and stand, and define a transit width more than the width of the slab, on both sides, of at least 25 mm per side, up to 50 mm per side, in order to prevent the slab from knocking against the guides when it enters the rolling mill.

This is also because the width of the slab is known but not to complete accuracy: the discrepancy can reach up to 10 mm and more.

Therefore, the alignment of the slab is imprecise by values of ±25–50 mm. Moreover, the edge-finishing rolls or edgers cannot act on the edges of the slab for more than 20 about 10 mm per side.

All this makes it impossible to center the slab if it arrives, at the exit from the furnace, misaligned by more than a minimum value, which can be compensated, with respect to the rolling axis.

WO A 99/24186, in the name of the present Applicant, shows devices able to thrust laterally on a slab advancing inside a furnace to align it with respect to a nominal centering axis.

Such devices have the problem that the lateral sides of the slab slide and are damaged during the movements of thrust, and also that the ends of the thrust devices overheat, which are inserted inside the furnace during the alignment step and thus brought into contact with said sides of the slab.

The present Applicant has devised and tested this invention to overcome all these shortcomings which cause serious operational, technological and quality problems in rolling plane products, particularly thin plane products of less than 2 mm.

SUMMARY OF THE INVENTION

The invention is set forth and characterized in the respective main claims, while the dependent claims describe other characteristics of the main embodiment.

The purpose of the invention is to center and axially align a slab emerging from the continuous casting machine so that it arrives at the entrance to the first stands, whether they be roughing stands, pre-finishing stands or finishing stands, perfectly aligned with the axis of said stands.

Another purpose is to obtain this alignment with a simple solution, which needs little maintenance, which can be installed on pre-existing plants too, without substantial modifications to the configuration of the plant, and which will guarantee an efficient result which can be controlled substantially for every rolling condition and for every type of product being worked.

The invention allows to reduce the extension or the lateral guides arranged upstream of the first stand, with consequent advantages in terms of lay-out, obtaining hotter slabs entering the stands and reducing the length of the plant.

The device according to the invention comprises a plurality of thruster elements arranged in cooperation with and laterally to the tunnel, heating or temperature-maintenance furnace, inside which the slab passes before being sent to the first rolling stand.

In the preferential embodiment, the invention provides a number of said thruster elements, between 4 and 7 for every side of the furnace, also according to the length of the furnace, arranged at a distance of about 3–6 meters from each other.

Each of the thruster elements is associated with its own actuator which generates a movement of the thruster element, preferentially on a plane substantially parallel to the plane of feed of the slab inside the furnace, and in a direction substantially orthogonal to the direction of feed of the slab.

Substantially in correspondence with the position of every thruster element, in a preferential embodiment; the furnace has doors which can be selectively opened, and which allow the relative thruster element to be introduced inside the furnace, thus allowing the thruster element to act on the lateral edge of the advancing slab to cause a desired and controlled displacement thereof on the sliding plane of the furnace.

Thanks to the presence of the doors, it is not necessary to maintain the thruster element constantly inside the furnace, thus increasing the duration and the operational reliability thereof.

Each of the thruster elements has a contact element at its end, equipped, in a preferential embodiment, with cooling means which allow them to cooperate with the hot advancing slab without risks of damage or wear.

The activation or each of the thruster elements is governed by detector means, arranged at least in cooperation with the inlet to the furnace, and/or inside the furnace; said detector means measure the entity of the misalignment or the slab with respect to the centered position on the axis of the first rolling stand.

A control and command unit receives the signal corresponding to the value of the misalignment and determines the controlled activation of the actuators which command the thruster elements, in order to achieve the desired centering of the slab.

The controlled activation, in a first embodiment, is different for each of the thruster elements. According to another embodiment, the controlled activation is performed according to groups of thruster elements.

According to a variant, position detector means are provided inside the furnace, and/or at outlet from the furnace, in order to verify the effectiveness of the intervention to correct the axial position of the slab and to supply possible command signals to the thruster elements located downstream and/or immediately upstream of the detector means.

In a first embodiment, the actuator means of the thruster elements consist of hydraulic jacks. According to a variant, the actuators are pneumatic or electric jacks.

According to a further variant, the activation of the thruster elements by the command and control unit can be correlated to the action of the lateral guides arranged downstream of the furnace and substantially in correspondence with the entrance to the first stand.

BRIEF DESCRIPTION OF THE DRAWINGS

These and other characteristics of the invention will become clear from the description of some preferential embodiments, given with reference to the attached drawings, wherein.

DETAILED DESCRIPTION OF PREFERRED EMBODIMENTS

Figure 1:
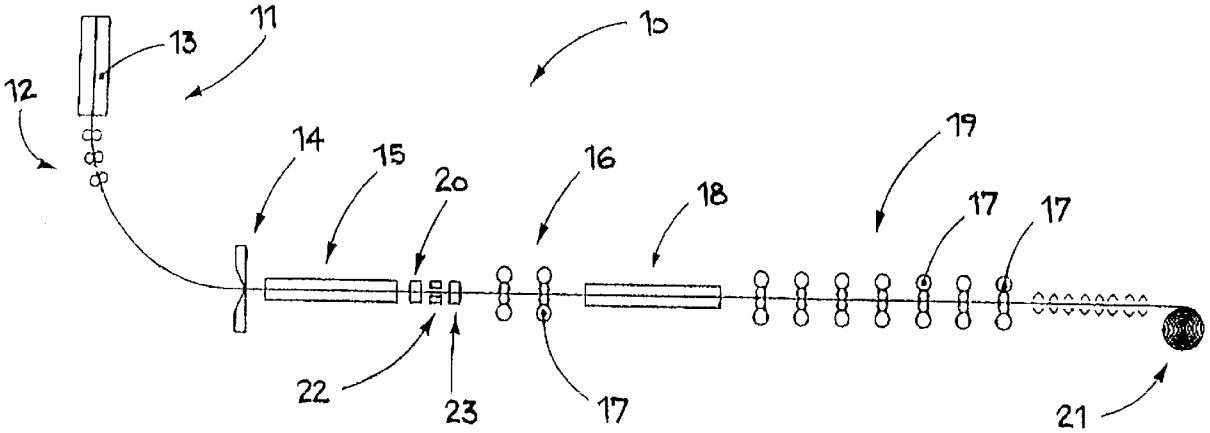
FIG. 1 is a schematic side view of a rolling line connected with the continuous casting to which the invention is applied.

The rolling line 10 shown schematically in FIG. 1 comprises a rolling train 19 arranged in line with a continuous casting 11 including a mold 13 and an extraction and straightening assembly with rolls 12.

Downstream of the assembly 12 there are shears for shearing to size 14 and a heating and/or temperature-maintenance furnace 15 which feeds the slabs 24 at temperature to a rolling train 16, in this case with two stands 17, which may be a roughing or pre-finishing train according to the case.

Between the train 16 and the finishing train 19, in this case, there is a system to equalize and restore the temperature 18, while downstream of the finishing train 19 there is a winding assembly 21 to wind the strip produced.

Between the heating furnace 15 and the train 16 there are conventional lateral guide systems 20, a descaling assembly 22 and an edging assembly 23.

Figure 2:
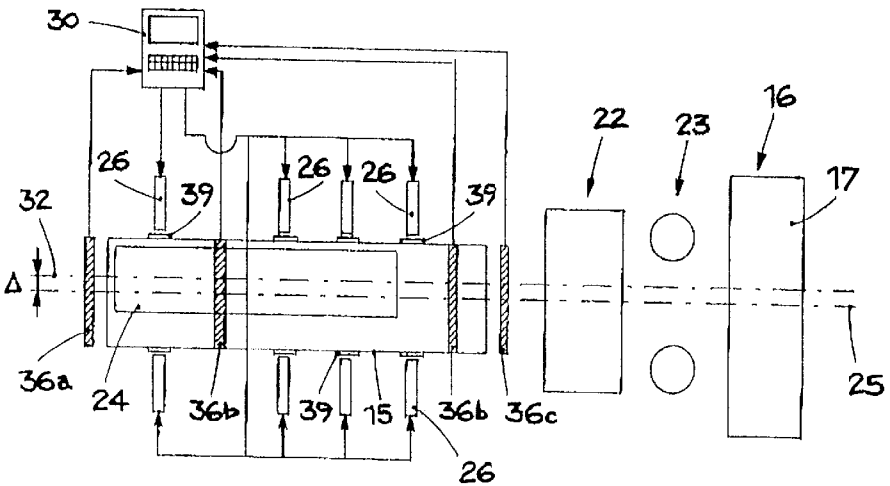
FIG. 2 is a schematic view from above of a segment of the line shown in FIG. 1 with the thruster elements according to the invention shown schematically.

According to the invention, in cooperation with the heating furnace 15, arranged laterally and on both sides thereof, there is a plurality of thruster elements 26 pre-arranged to axially align the slab 24 advancing inside the furnace 15 with the rolling axis 25 of the stands 17, in particular with the axis 25 of the first stand 17 of the train 16 (FIG. 2).

Each of the thruster elements 26 comprises a fork-shaped rod 27 supporting at the end a contact element 28, consisting in this case of a cooled roller 29.

Inside the rod 27 there are conduits 33, associated with a feed pipe 35*a* and a discharge pipe 35*b*, able to convey a cooling fluid, preferably water, and make it circulate through the roller 29.

The rod 27 is associated at the rear with an actuator 31, preferably of the hydraulic type, able to impart a movement to the rod 27 on a plane substantially parallel to the plane on which the slab 24 lies as it advances inside the furnace 15 and in direction substantially orthogonal to the direction of feed.

The actuator 31 is mounted, in this case, on a supporting bracket 38.

The activation of each actuator 31 to move the relative thruster element 26 is governed by a control and command unit 30.

To be more exact, the control and command unit 30, by means of at least one detector element 36*a* arranged at inlet to the furnace 15, receives a signal relating to the axial position of the advancing slab 24, and measures a possible discrepancy $\Delta$ of the axis 32 of the slab 24 with respect to the rolling axis 25.

The embodiment shown in FIG. 2 provides a situation where the two axes 25 and 32 are parallel, but it is obvious that this condition may also not occur, and the two axes may be reciprocally aslant According to the value of the discrepancy $\Delta$, the unit 30 commands the command actuators 31 to be activated, either individually or in groups, in order to introduce the respective thruster elements 26 inside the furnace 15 and displace the slab 24 laterally on the motorized rollers 34 which define the plane of feed inside the furnace 15.

To be more exact, the thruster element 26 is moved inside the furnace 15 until it takes the cooled roller 29 into contact with the lateral edge of the slab 24; then it is further displaced towards the slab 24 according to the desired lateral displacement to be imparted to the slab 24.

In order to introduce the thruster elements 26, on its lateral walls the furnace 25 includes doors 39 which can be selectively opened and which are advantageously activated only for the time needed for the thruster elements 26 to be introduced and for them to impart their thrusting action on the slab 24.

The activation of the thruster elements 26 is regulated by the command and control unit 30 so as to re-establish the condition of axial alignment between the axis 32 of the slab 24 and the axis 25 of the rolling stand 17.

In this case, there are four thruster elements 26 for every side of the furnace 15, distributed along its length, in order to achieve a regular and uniform lateral displacement which will allow to cancel any discrepancies Δ, even considerable ones.

According to the embodiment shown here, there are further detector means 36*b* provided inside the furnace 15 and 36*c* immediately at outlet from the furnace 15, in order to verify that the intervention of the thruster elements 26 has been correct, and possibly to send a feedback signal to the unit 30 for a further controlled activation of the thruster elements 26, on one side or on the other.

Figure 3:
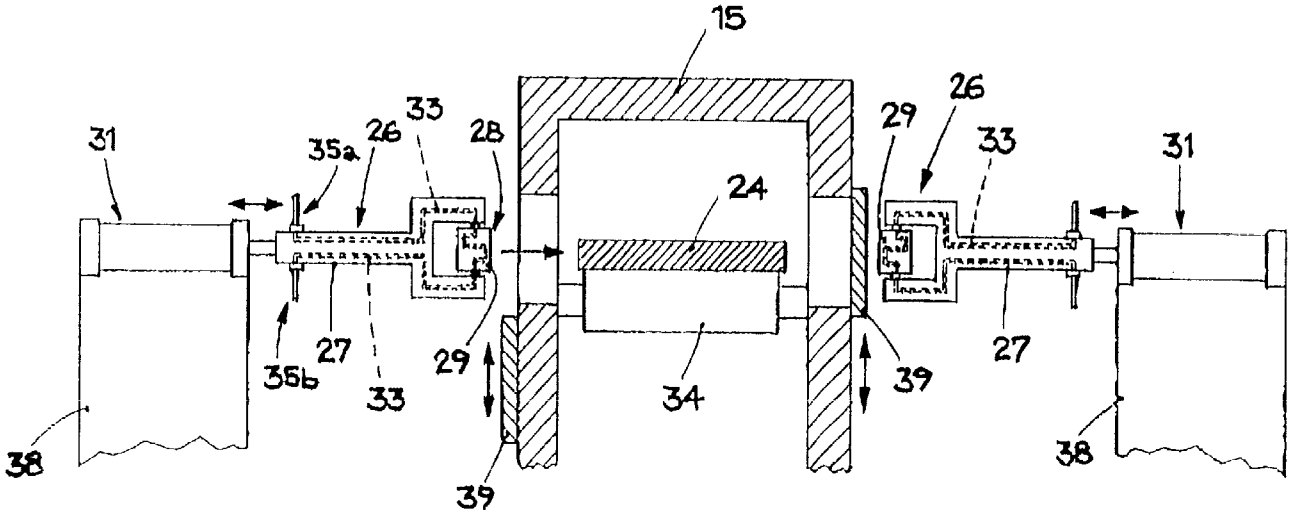
FIG. 3 shows a schematic, transverse view of a first embodiment of the invention.

The embodiment shown in FIG. 3 provides that the rod 27 of the thruster element 26 is arranged in axial prosecution of the relative actuator 31.

Figure 4:
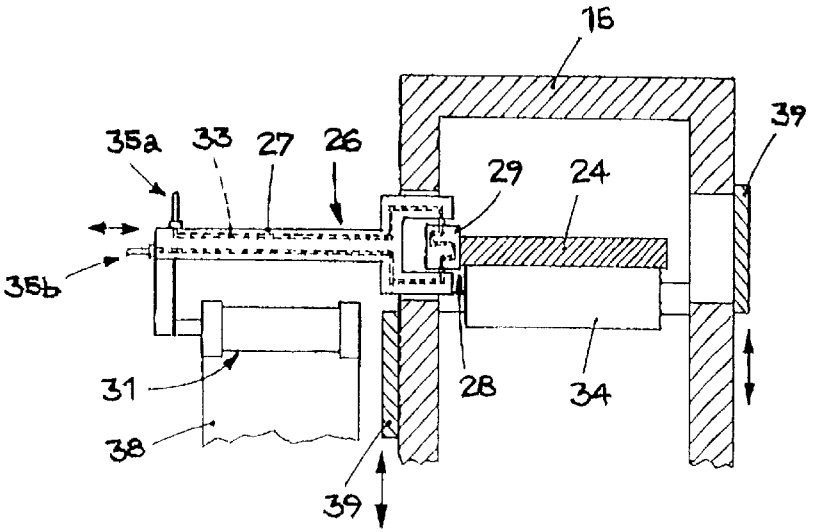
FIG. 4 shows a detail of a variant of FIG. 3.

According to the variant shown in FIG. 4, in order to reduce the bulk occupied by the thruster elements 26 laterally to the furnace 15, the rod 27 is arranged above and parallel to the relative actuator 31.

Although the invention has been described with reference to several preferential embodiments, it is obvious that modifications arid variants may be made thereto but these shall remain within the field of protection defined by the attached claims.

What is claimed is:

1. A method to control an axial position of slabs emerging from continuous casting applied in rolling plants comprising at least a casting machine (11), a heating and/or temperature maintenance furnace (15) and a roughing and prefinishing (16) or finishing train (19) comprising at least one rolling stand (17), said method serving to align a longitudinal axis (32) of a slab (24) entering said furnace (15) with a longitudinal axis (25) of a first said rolling stand (17), the method comprising a first step to control the axial position of the slab (24) and a second step to activate at least one thruster element (26) arranged laterally to the furnace (15) and able to be introduced inside said furnace (15) to act on an edge of the slab (24) and displace the slab laterally in a desired and controlled manner on a relative plane on which the slab (24) lies, according to a measured discrepancy (Δ) between said axis (32) of the slab (24) and said axis (25) of the first rolling stand (17), wherein said at least one thruster element (26) has a contact element (28) able to cooperate with the edge of the slab (24) advancing inside said furnace (15), wherein a contact rolling element of the thruster element acts on the edge of the slab (24) and displaces the slab laterally in the desired and controlled manner on the relative plane on which the slab (24) lies, and further comprising cooling the contact rolling element by circulating cooling fluid through the contact rolling element.

2. The method as in claim 1, wherein said first step of controlling the axial position is performed at least in correspondence with an entrance to said furnace (15).

3. The method as in claim 1, wherein said first step of controlling the axial position is performed inside said furnace (15).

4. The method as in claim 1, comprising at least a step to control the axial position of the slab (24) performed immediately at an outlet from said furnace (15).

5. The method as in claim 1, wherein there is more than one said thruster element and each of said thruster elements (26) is activated individually.

6. The method as in claim 1, wherein there is more than one said thruster element and said thruster elements (26) are activated in groups.

7. The method as in claim 1, wherein in coordination with the movement to introduce said at least one thruster element (26) inside the furnace (15), doors (39) in walls of said furnace (15) are selectively opened, only for a time needed for said at least one thruster element (26) to act on the slab (24) and for said at least one thruster element (26) to return to outside the furnace (15).

8. The method as in claim 1, comprising at least a step to control the axial position of the slab (24) performed immediately outside said furnace at an outlet from said furnace (15).

9. The method as in claim 1, wherein the thruster element roller for contacting the slab is located at one end of the thruster element, the thruster element roller has a thruster element roller axis orthogonal to a plane on which the slab (24) lies inside the furnace (15), and the thruster element roller rotates about the thruster element roller axis.

10. The method as in claim 9, wherein the thruster element roller has a cooling channel therein.

11. The method as in claim 1, wherein each thruster element contacts at most a respective lateral edge of the slab.

12. The method as in claim 1, wherein the thruster element has an end for extending furthest into the furnace and the thruster element end for extending furthest into the furnace contacts the edge of the slab.

13. The method of claim 1, wherein the contact rolling elements (29) are mounted at one end of a fork-shaped arm (27) of the thruster element (26), these contact elements having normally a vertical working position, and a vertical axes of rotation.

14. A device to control an axial position of slabs emerging from continuous casting, applied in rolling plants comprising at least: a casting machine (11), a heating and/or temperature maintenance furnace (15), a roughing and prefinishing (16) or finishing train (19), means (36*a*, 36*b*, 36*c*) to detect the axial position of the slab (24), a plurality of thruster elements (26) arranged in cooperation with and laterally to said furnace (15) and able to be selectively introduced inside said furnace (15) moving on a plane substantially parallel to a plane on which the slab (24) lies inside the furnace (15) and in a direction substantially orthogonal to a direction of feed of the slab (24), and a command and control unit (30) able to receive, from said means (36*a*, 36*b*, 36*c*) to detect, a signal relating to the axial position of the slab (24) and to activate said thruster elements (26) to obtain an alignment of the axis (32) of said slab (24) with an axis (25) of a first said rolling stand (17), said thruster elements (26) having a contact element (28) able to cooperate with an edge of the slab (24) advancing inside said furnace (15), wherein the thruster element comprises a contact rolling element to act on the edge of the slab (24) and displace the slab laterally in a desired and controlled manner on a relative plane on which the slab (24) lies, and wherein the contact rolling element further comprises a cooling channel for cooling the contact rolling element by circulating cooling fluid through the cooling channel of the contact rolling element.

15. The device as in claim 14, wherein at least one said means (36*b*, 36*c*) to detect the axial position of the slab (24) is respectively arranged inside and/or at an outlet from said furnace (15).

16. The device as in claim 14, wherein said thruster elements (26) comprise a rod (27) having an end carrying said contact element (28).

17. The device as in claim 11, wherein a cooling means comprise conduits (33) to convey and circulate cooling fluid arranged inside said rod (27) and associated with a feed pipe (35*a*) and a discharge pipe (35*b*).

18. The device as in claim 16, wherein each of said thruster elements (26) is associated with its own actuator (31) governed by said command and control unit (30).

19. The device as in claim 18, wherein said actuator (31) is arranged in axial alignment with a relative rod (27).

20. The device as in claim 18, wherein a relative rod is arranged above and parallel to the actuator.

21. The device as in claim 14, wherein said contact element (28) consist of a roller (29).

22. The device as in claim 14, wherein at least one said means (36*b*, 36*c*) to detect the axial position of the slab (24) is respectively arranged inside and/or immediately outside at an outlet of said furnace (15).

23. The device as in claim 14, wherein each of said thruster elements (26) is associated with its own actuator (31) governed by said command and control unit (30).

24. The device as in claim 14, wherein the contact rolling element for contacting the slab is located at one end of the contact rolling element, the contact rolling element has a thruster element roller axis orthogonal to a plane on which the slab (24) lies inside the furnace (15), and the contact rolling element is rotatable about the contact rolling element axis.

25. The device as in claim 24, wherein the thruster element roller has a cooling channel therein.

26. The device as in claim 14, wherein each thruster element is for respectively contacting at most the edge of the slab.

27. The device as in claim 14, wherein the thruster element has an end for extending furthest into the furnace and the thruster element end for extending furthest into the furnace is for contacting the edge of the slab.

28. The device of claim 14, wherein the contact rolling elements (29) are mounted at one end of a fork-shaped arm (27) of the thruster element (26), these contact elements having normally a vertical working position, and a vertical axes of rotation.

29. A device to control an axial position of slabs emerging from continuous casting, applied in rolling plants comprising at least: a casting machine (11), a heating and/or temperature maintenance furnace (15), a roughing and prefinishing (16) or finishing train (19), means (36*a*, 36*b*, 36*c*) to detect the axial position of the slab (24), a plurality of thruster elements (26) arranged in cooperation with and laterally to said furnace (15) and able to be selectively introduced inside said furnace (15) moving on a plane substantially parallel to a plane on which the slab (24) lies inside the furnace (15) and in a direction substantially orthogonal to a direction of feed of the slab (24), and a command and control unit (30) able to receive, from said means (36*a*, 36*b*, 36*c*) to detect, a signal relating to the axial position of the slab (24) and to activate said thruster elements (26) to obtain an alignment of the axis (32) of said slab (24) with an axis (25) of a first said rolling stand (17), said thruster elements (26) having a contact element (28) able to cooperate with an edge of the slab (24) advancing inside said furnace (15), wherein at least one said means (36*a*) to detect the axial position of the slab (24) is arranged in cooperation with an inlet to the furnace (15).

30. A method to control an axial position of slabs emerging from continuous casting applied in rolling plants comprising at least a casting machine (11), a heating and/or temperature maintenance furnace (15) and a roughing and prefinishing (16) or finishing train (19) comprising at least one rolling stand (17), said method serving to align a longitudinal axis (32) of a slab (24) entering said furnace (15) with a longitudinal axis (25) of a first said rolling stand (17), the method comprising a first step to control the axial position of the slab (24) and a second step to activate at least one thruster element (26) arranged laterally to the furnace (15) and able to be introduced inside said furnace (15) to act on an edge of the slab (24) and displace the slab laterally in a desired and controlled manner on a relative plane on which the slab (24) lies, according to a measured discrepancy ($\Delta$) between said axis (32) of the slab (24) and said axis (25) of the first rolling stand (17), wherein said at least one thruster element (26) has a contact element (28) able to cooperate with the edge of the slab (24) advancing inside said furnace (15), wherein the furnace has doorways and each doorway has a movable door and the thruster elements enter and exit the furnace through the respective doorways and the doors move to close the doorway when the respective thruster element is outside the furnace.

31. A device to control an axial position of slabs emerging from continuous casting, applied in rolling plants comprising at least: a casting machine (11), a heating and/or temperature maintenance furnace (15), a roughing and prefinishing (16) or finishing train (19), means (36*a*, 36*b*, 36*c*) to detect the axial position of the slab (24), a plurality of thruster elements (26) arranged in cooperation with and laterally to said furnace (15) and able to be selectively introduced inside said furnace (15) moving on a plane substantially parallel to a plane on which the slab (24) lies inside the furnace (15) and in a direction substantially orthogonal to a direction of feed of the slab (24), and a command and control unit (30) able to receive, from said means (36*a*, 36*b*, 36*c*) to detect, a signal relating to the axial position of the slab (24) and to activate said thruster elements (26) to obtain an alignment of the axis (32) of said slab (24) with an axis (25) of a first said rolling stand (17), said thruster elements (26) having a contact element (28) able to cooperate with an edge of the slab (24) advancing inside said furnace (15), wherein the furnace has doorways and each doorway has a movable door and the thruster elements are able to enter and exit the furnace through the respective doorways and the doors can be moved to close the doorway when the respective thruster element is outside the furnace.

* * * * *